United States Patent [19]

Stoll et al.

[11] Patent Number: 4,687,189

[45] Date of Patent: Aug. 18, 1987

[54] SHORT STROKE ACTUATOR

[76] Inventors: Kurt Stoll, Lenzhalde 72, 7300 Esslingen a.N; Gerhard Hihn, Schurwaldstrasse 7, 7300 Esslingen-Berkheim, both of Fed. Rep. of Germany

[21] Appl. No.: 822,521

[22] Filed: Jan. 21, 1986

[30] Foreign Application Priority Data

Jan. 26, 1985 [DE] Fed. Rep. of Germany ..... 3502575

[51] Int. Cl.[4] ..... B25B 11/00

[52] U.S. Cl. ..... 269/22

[58] Field of Search ..... 269/22, 266; 254/93 HP; 92/90, 93, 94, 96, 103 F, 104, 35

[56] References Cited

U.S. PATENT DOCUMENTS

| | | | |
|---|---|---|---|
| 2,396,413 | 3/1946 | Egger | 269/22 |
| 2,560,902 | 7/1951 | Smith | 269/22 |
| 2,714,011 | 7/1955 | Albee | 269/22 |
| 2,778,865 | 1/1957 | Kongsgaarden | 269/22 |
| 3,237,252 | 3/1966 | Ratcliffe | 269/22 |
| 3,253,854 | 5/1966 | Hollander | 269/22 |
| 3,490,759 | 1/1970 | Troutner | 269/22 |
| 3,565,398 | 2/1971 | Floria | 254/93 HP |
| 3,608,809 | 9/1971 | Cushman | 269/22 |
| 3,638,973 | 2/1972 | Poletti | 269/22 |
| 3,856,291 | 12/1974 | Nilsen | 269/22 |
| 4,470,585 | 9/1984 | Bavelloni | 269/22 |

*Primary Examiner*—Robert C. Watson

*Attorney, Agent, or Firm*—McGlew and Tuttle

[57] ABSTRACT

A short-stroke clamping element for exerting a clamping or holding force on a workpiece has a bar-like form with its length direction normal to the direction of the clamping force to be produced. There is an internal pressure space that is put under pressure for operation of the device. The pressure space is sealed off peripherally and extends essentially along the full length of the clamping element. At least one of the sides of the element forms a claiming face constituted by a wall that is able to be moved outwards by admitting compressed air to the pressure space.

14 Claims, 19 Drawing Figures

SHORT STROKE ACTUATOR

BACKGROUND OF THE INVENTION

The invention relates to a short stroke actuator for producing a holding or retaining force on a workpiece and comprising a pressure space which is adapted to be put under pressure for operation of the actuator.

If a workpiece is to be machined on a machine tool it first has to be located on the work table of the machine tool and then clamped or otherwise fixed in place so that it is not dislodged during the ensuing machining operation, as for example the boring of a hole in the workpiece. It is more especially in mass production techniques that workpieces are held in place by an array of short stroke actuators designed to be mounted on the machine tool, and whose piston rods are moved outwards when the actuator is supplied with fluid under pressure, and which push the work against an abutment. The number of clamping cylinders then needed in the array will be dependent on the dimensions of the respective workpiece. If the work is in the form of a sheet or broad, it will be necessary to provide a plurality of clamping cylinders arrayed in a row so that they may engage the nearest edge of the work at spaced positions.

However, such a multiple arrangement of clamping cylinders is a relatively complex piece of equipment or "hardware" and is therefore high in price. Furthermore, during retooling the production facilities it is necessary to separately adjust the positions of the clamping cylinders so that such adaptation of the production devices is slowed down. A further point to be considered is that the clamping cylinders only engage the work at separate points rather than over large areas so that there is a high concentration of surface force in order to achieve the necessary clamping or retaining effect. If the work is made of wood, the surface may then be damaged and be scored by the piston rods of the actuators.

SHORT OUTLINE OF THE INVENTION

Therefore one object of the invention is to devise a short stroke actuator of the initially mentioned type with whose aid workpieces with a comparatively large edge area to be held may be clamped or retained in a substantially cheaper and simpler manner than hitherto.

A further aim of the invention is to design such a short stroke actuator that is suitable for use with workpieces that are sensitive to excessive clamping pressures.

In order to achieve these or other aims that will appear from the following specification and claims, the clamping actuator is of elongated form with the direction of elongation extending at a right angle to the direction of the clamping force and the pressure space therein, which is sealed off around the periphery and at the ends of the clamping actuator, extends essentially along the full length of the clamping actuator and along at least one longitudinal side of the actuator the pressure space is delimited by a wall able to be moved in an outward direction and defining a work-engaging face.

Instead of a series of clamping actuators it is now possible to achieve the desired effect with only one single clamping element in the form of such a clamping bar that is secured along the work support table of the machine tool. Such a clamping bar is very simple in structure and in contradistinction to a conventional arrangement only needs one connection for the supply and return of the driving fluid. If the pressure space is supplied with driving fluid under the control of a valve, the said longitudinal side of the bar is moved or bulges in an outward direction so that a pressure cushion takes effect along the full length of the unit, which makes engagement with the work. Such a short stroke clamping actuator produces very high clamping forces even if it has a very small size. In this respect, owing to the continuous engagement with the work, the specific surface pressure is lower than hitherto and furthermore it is possible for the moving wall of the bar to adapt itself to unevenness of the edge of the work. A further advantage is to be seen in the practically complete freedom from the necessity of maintenance operations on such a clamping actuator.

The clamping bar in accordance with the invention may be employed not only in connection with the clamping of work on a machine tool table, but furthermore for instance in conjunction with materials handling devices, in which the clamping bar lends itself to use as a part of a gripping device. The clamping bar of the invention may be used in all those cases in which some object is to be held, clamped, fixed or only lightly and temporarily secured. It is furthermore possible to utilize a plurality of clamping bars in order to increase the length along which the clamping or holding force takes effect, such clamping bars then being arrayed in a consecutive row. It is also possible for a number of clamping elements with walls moving in parallel to be placed on top of each other so that tall objects may be grasped or held by means engaging practically all their available areas. It is furthermore possible to place a number of clamping elements in tandem so that one clamping element will have its moving wall in engagement with the clamping element placed in front of it and the strokes are summated.

A further advantage is produced if the clamping element does not have the form of a rectangular prism but is bent in its shape so as to provide for adaptation to an uneven workpiece, as for example with an arcuate form, or one with the form of a closed ring or with that of a helix, without special steps having to be taken to adapt the clamping element to the work.

A further expedient application of the clamping element of the invention is to be seen in use as a brake element, as for example in a disk brake.

Further useful effects of the invention will be gathered from the following account of working examples thereof as shown in the accompanying figures.

LIST OF THE SEVERAL VIEWS OF THE FIGURES

Figure 1:
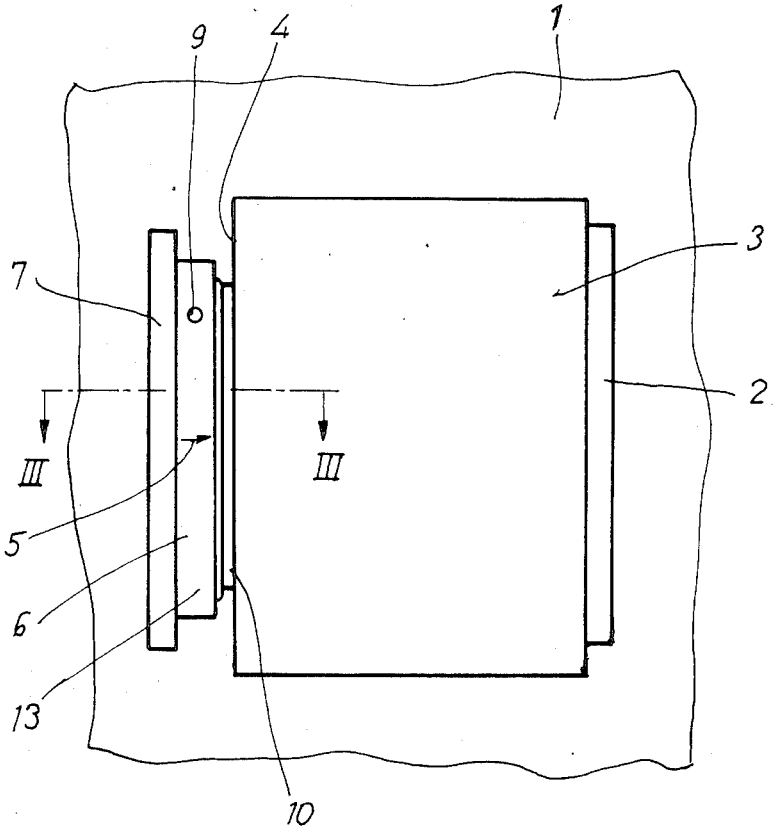
FIG. 1 is a view from above of a workpiece held on the work table of a machine tool with the aid of a clamping element in accordance with the invention.
Figure 2:
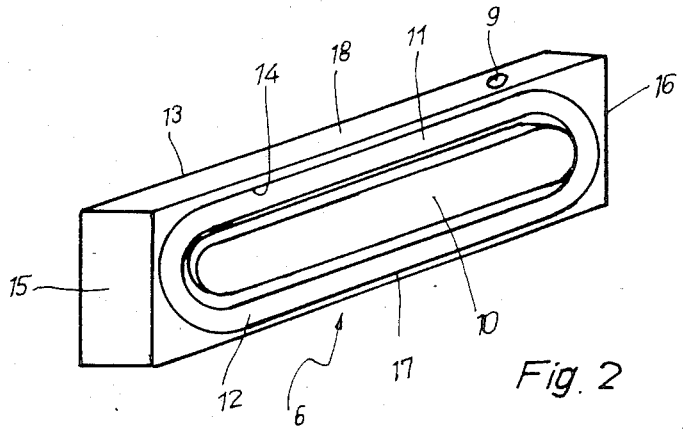
FIG. 2 is an orthogonal view of a preferred embodiment of the invention looking towards the clamping or work engaging face.
Figure 3A:
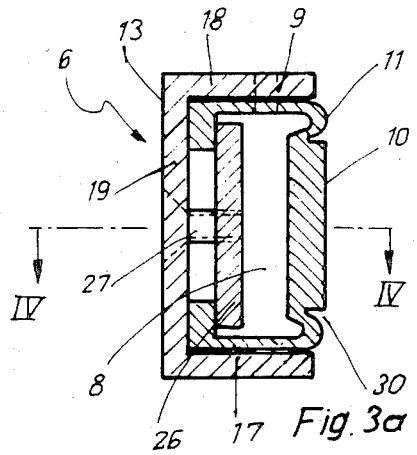
Figure 3B:
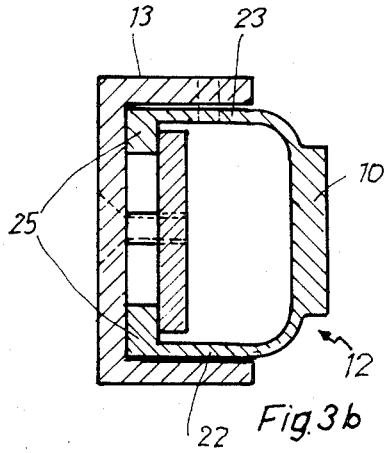

FIGS. 3*a* and 3*b* show the clamping element of FIG. 2 in a cross section taken on the line III—III of FIG. 1 to indicated the conditions of the element without pressure and under pressure respectively.

Figure 4:
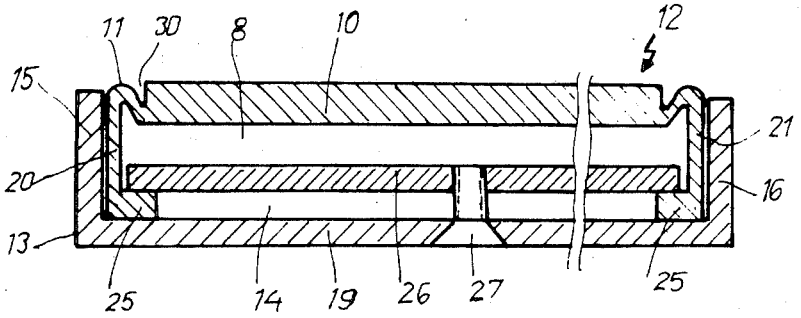

FIG. 4 shows the same clamping element in longitudinal section as taken on the section line IV—IV of FIG. 3*a*.

Figure 5A:
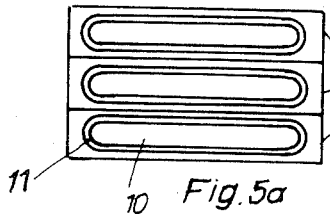
Figure 5B:
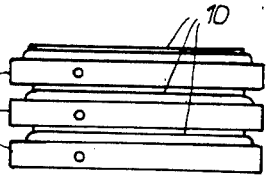
Figure 5C:
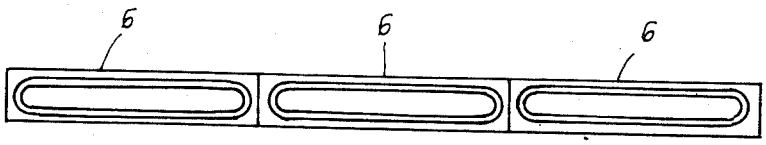

FIGS. 5*a*, 5*b* and 5*c* each show a multiple array of clamping elements in accordance with FIG. 2.

Figure 6:
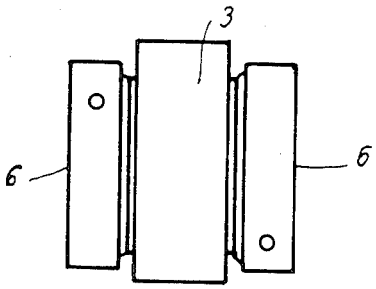

FIG. 6 shows two clamping elements in accordance with FIG. 2 looking in downward direction and with a workpiece held between the elements.

Figure 7:
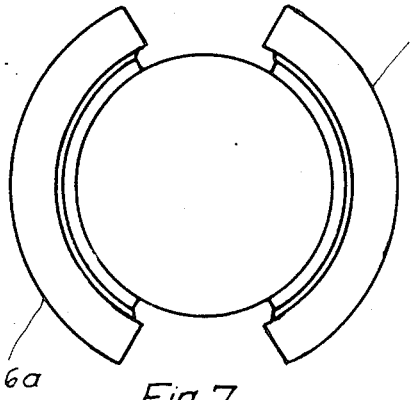
Figure 8:
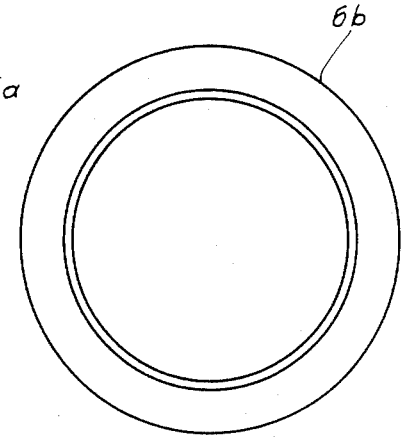
Figure 9:
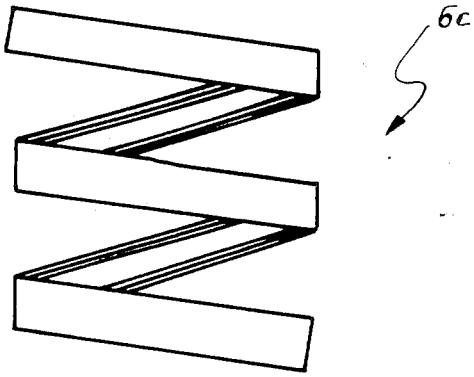

FIGS. 7, 8 and 9 respectively show a modified form of the clamping element in accordance with FIG. 2 with an arcuate, annular and helical form respectively.

Figure 10:
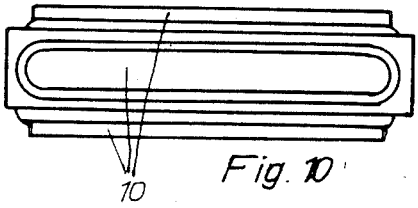

FIG. 10 shows a further modified form of the clamping element with a plurality of moving walls.

Figure 11:
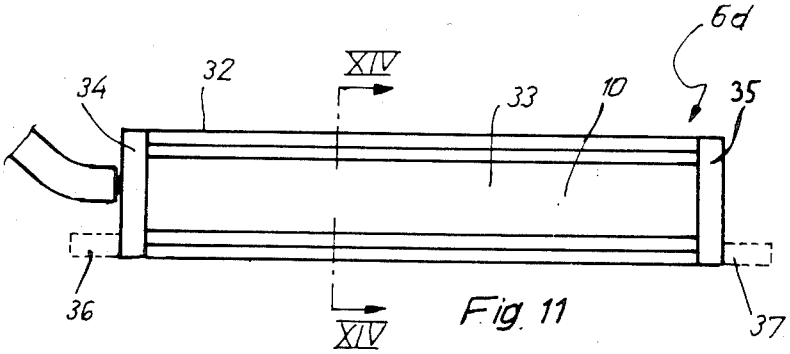

FIG. 11 illustrates a further working example of the clamping bar in accordance with the invention looking towards its front surface, that is to say towards the moving wall.

Figure 12:
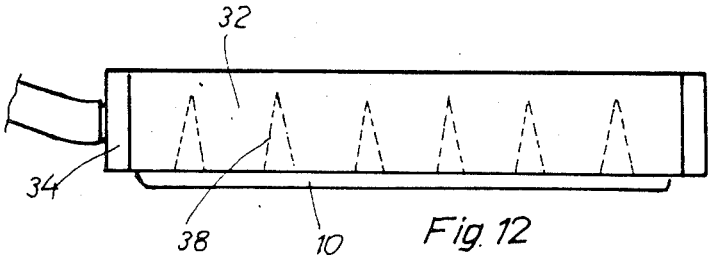

FIG. 12 shows the clamping element of FIG. 11 as seen from above as in FIG. 1.

Figure 13:
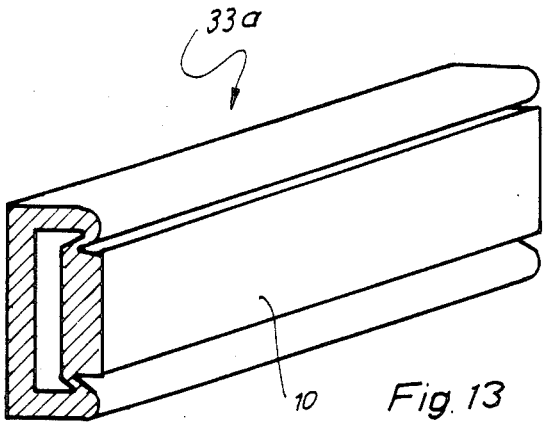

FIG. 13 shows a plastic structure in the form of a moulding or section for production of the clamping element in accordance with FIGS. 11 and 12 or of clamping element without any support bar.

Figure 14:
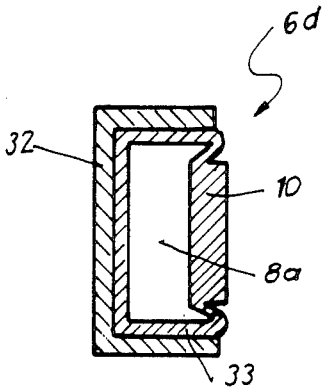

FIG. 14 shows the clamping element as in FIGS. 11 and 12 in a cross section taken on the line XIV—XIV in FIG. 11.

Figure 15:
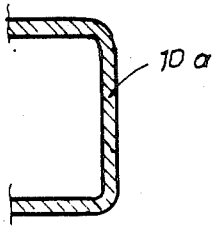
Figure 16:
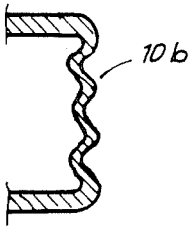

FIGS. 15 and 16 show possible modifications in the form of a cross section of the moving wall.

DETAILED ACCOUNT OF WORKING EXAMPLES OF THE INVENTION

Turning more specifically to FIG. 1 of the drawings, the reader will be able to see that an abutment 2 like a rail is secured to the work table 1 of a machine tool. A piece of work 3 having a comparatively large size, more especially in the length direction of the abutment, is clamped on the table by the use of a short stroke clamping element that is fixed to the table 1 in a position in which it may engage the edge 4 of the work opposite to the abutment 2. The short stroke clamping element has an elongated form like that of a bar with its length running at a right angle to the direction 5 of the clamping force so that the element is formed by a clamping bar 6. This clamping bar 6 may be attached directly to the table 1 or be mounted on an attachment rail 7 that is rigidly joined to the table 1 in a conventional manner.

The interior of the clamping bar 6 takes the form of a pressure space 8 to be seen in the sectional views of FIGS. 3 and 4 and which extends essentially along the full length of the clamping element and is sealed off peripherally including the ends. The pressure space 8 may be pressurized with a fluid, for which purpose there is a compressed air inlet port 9 which in the present instance is situated in a side wall of the clamping bar, such wall being perpendicular to the moving wall 10 that is yet to be described. By way of a pressure fluid line, which is not shown in the present case, it is possible for the pressure space 8 to be put under pressure and vented as may be desired. The control of the supply of fluid under pressure and outlet thereof is by means of a valve, which is not shown since such control systems will be familiar to the man versed in the fluid power art.

Along the longitudinal side of of the pressure space 8 the same is sealed by the moving wall 10, which during operation forms the holding or work engaging face adjacent the workpiece 3. Like the pressure space 8, the moving wall will be seen to extend for practically the complete length of the clamping bar. If the pressure space 8 is pressurized, the wall 10 will move outwards, i.e. in the direction 5 of the clamping force. The result is then a sort of bar-shaped pressure cushion, which is able to "breath" along the moving wall and bulges outwards when the pressure space 8 is pressurized. FIG. 3*a* shows the wall position when the pressure space is not under pressure, whereas FIG. 3*b* shows the condition when the pressure space 8 is pressurized. To hold or clamp a piece of work, a stroke of a few millimeters, as for instance one or two millimeters is sufficient. The moving wall 10 then comes into engagement with the adjacent work edge 4 over a large area, that is to say practically along the full length of the clamping bar and will press the work against the abutment 2. It is then possible to put a tool such as a drill, a router or the like into operation over the work and above the plane of the figures and engage the work 3 therewith to machine it. If the pressure space 8 is depressurized the moving wall 10 will be relaxed or "go limp" and the work will be released.

The moving wall may be manufactured of a flexible material, as for example in the instant case a material that in addition is soft and elastic so that the wall will snugly fit the outer form of the workpiece. The material may be a suitable plastic with rubber-like properties, that is to say a soft plastic.

It will furthermore be seen from the drawing that the moving wall 10 may be attached to the adjacent parts of the clamping bar in the manner of a joint and more especially in the form of a part 11 of the material with a corrugated or folded form and/or with a reduced thickness so that there is a bellow-like arrangement and when the clamping bar is pressurized the deformation will be limited to the material part 11 whereas the moving wall 10 will be displaced parallel to itself. In such a case the moving wall 10 may be made flat or essentially so, with a reinforcement if necessary, that is to say in a thicker form or with a reinforcing inlay.

It will be seen from FIG. 15 that if the wall is suitably thin and/or has a suitable elasticity it is possible to dispense with a joint attachment of the moving wall 10*a*. In this case the moving wall 10*a* will be moved outwards like a flexible tube when it is put under pressure and on abutting the workpiece will take on the same form as the face of the workpiece, i.e. a flat one.

A further possible modification of the cross section of the moving wall is to be seen in FIG. 16. In this case the moving wall 10*b* has a corrugated or folded form as will be made clear from the cross section, i.e. the corrugations or folds run in the length direction of the clamping bar. It will be readily seen that when this moving wall 10*b* is put under pressure it will swell or bulge in an outward direction to a greater extent than is possible with the wall 10*a* of FIG. 15 owing to the presence of the corrugations or folds.

In any case the material used for the moving wall of its joints for connection will have such a wall thickness and such a characteristic that at the pressures coming into question (which are preferably in a low range more especially of the order of 6 bar) one may be certain that the work is securely held and clamped, that is to say, the necessary stroke is available. If the material is elastic, the moving wall will automatically return when the pressure is removed. However in the case of material which is only flexible (and is not elastic), the limpness of the material in the pressureless condition will still mean that there will be no trouble at all as regards inserting and removing the workpiece 3.

In all the working embodiments of the invention the moving wall is formed by an integral plastic or resin molded structure which delimits the pressure space on more than one side, the molded wall structures other than the moving wall being reinforced or supported in such a way that they do not deform on the admission of compressed air.

In the case of FIGS. 2 through 4 such a plastic molded structure 12 is used and secured in a support bar 13, forming a housing and made of rigid material as for instance a hard resin or more particularly metal. The support bar 13 has rigid walls on all sides with the exception of the side with the moving wall 10 and it is a question of a rigid structure. The moving wall 10 is placed in an otherwise open elongated aperture 14 in the support bar 13 which is in the form of a generally rectangular prism. The plastic molded structure 12 is placed in the aperture 14. The ends of the elongated aperture 14 are formed by integrally molded end walls 15 and 16 forming parts of the support bar. The end walls 15 and 16 and the side walls 17 and 18 forming the borders of the elongated aperture 14 may be thin to leave more space for the moving wall 10 so that it may be made as large as possible. Both in cross section (FIG. 3) and also in longitudinal section (FIG. 4) the support bar 13 will be seen to have the section of a channel or U, the elongated aperture 14 being opposite a bottom wall 19.

Furthermore the plastic or resin molded structure 12 has integrally molded end walls 20 and 21 and side walls 22 and 23 extending away from the moving wall 10 so that not only its longitudinal section (FIG. 4) but also its cross section (FIGS. 3*a* and 3*b*) generally have the form of a letter U. The dimensions of the plastic molded structure 12 are adapted to suit the dimensions of the elongated aperture 14 in the support bar 13 so that the molded structure 12 may be so inserted into the elongated aperture 14 with the moving wall 10 to the outside and then secured in place in some suitable way. Then the side walls 22 and 23 extending from the moving wall 10 cooperate with the end walls 20 and 21 of the plastic molded structure in forming a complete molded structure wall enclosing the elongated aperture 14 on all four sides. This provides a particularly simple way of defining and sealing off the pressure space 8.

The interior space or cavity of the clamping bar is thus walled in by the bottom wall 19 of the support bar 13, the molded structure wall 20 through 23 extending around it on all four sides and also the moving wall 10. If the plastic molded structure 12, that is to say at its side walls 20 through 23, is secured in place by an adhesive for instance on the support bar, this inner space will form the pressure space of the clamping bar. In the present instance however a different form of attachment has been selected so that the pressure space 8 is somewhat smaller.

This method of attachment involves the provision of a retaining flange 25 on the edge of the support bar of the encircling side walls 20 through 23, nearest the bottom wall 19. This retaining flange 25 is integrally molded and projects inwards so as to overlap a retaining plate 26 contacting it on its side facing the moving wall. This retaining plate 26 is held in place by at least one screw 27, extending through the bottom wall 19, which presses the plate against the retaining flange 25 so that the flange is held between the plate 26 and the bottom wall 19 and there is a sealing engagement between the flange and the wall 19 and the pressure space 8 is sealed off.

The supporting bar 13 and the plastic molded structure 12 have holes aligned with the compressed air port 9.

As seen in a direction looking towards the moving wall the end walls 20 and 21 of the plastic molded structure 12 will be seen to have an arcuate and more particularly semi-circular form, the wall of the elongated aperture 14 being correspondingly curved at its ends. This will be seen from FIGS. 2, 5*a* and 5*c*. The design with such curved ends offers advantages from the manufacturing and sealing aspects owing to the absence of corners.

The part 11 of the material that forms the connection or transition between the moving wall 10 and the encircling molded structure side wall 20 through 23 forms an outwardly protruding bead or fold whose side adjacent to the moving wall 10 is substantially thinner than the latter. There is an outwardly opening groove 30 between the moving wall 10 and the bead. The moving wall 10 is somewhat proud of the supporting bar 13, even when the pressure space is vented, so that it is always only the moving wall 10 that comes into contact with the structure to be clamped or held while the bar 13 is kept clear thereof.

The clamping element preferably has the form of a block or rectangular prism. This furthermore makes possible the applications shown in FIGS. 5*a*, 5*b* and 5*c*. As will be seen from FIG. 5*a* it is possible for a number of clamping elements 6 to be arrayed together with contiguous side walls so that the moving walls 10 are aligned and together produce a tall clamping and holding surface. This array of bars is therefore suitable for tall objects to be held or clamped.

In accordance with FIG. 5*b* it will be seen that a number of clamping elements 6 may be placed in tandem so that the moving wall 10 of one clamping element 6 abuts the bottom wall of the next consecutive element with the result that the strokes of the elements are summated.

In FIG. 5*c* the clamping elements 6 are shown with their end walls abutting so that an elongated clamping element array is produced.

FIG. 6 shows how a structure 3 may be held with clamping elements 6 on each side of it, the elements being so arranged that their moving walls 10 are facing each other.

It is to be understood that the clamping element may be used not only for fixing a workpiece on the table of a machine tool. It may be used in all those cases in which something is to be clamped, held or fixed for any purpose whatsoever. Furthermore the clamping element may be utilized to actuate a braking element as for example the pad of a disk brake.

A further application is as the gripping means of a materials handling device, which may be equipped with such clamping elements. Such a gripping is similar to that of FIG. 6.

The clamping element does not have to be linear for all applications and if the workpiece is uneven the clamping element may have a matching non-linear form. FIG. 7 shows two such non-linear clamping elements 6*a* which are circular and are designed for holding round objects. In the case of FIG. 8 it is a question of an annular clamping element 6*b* in a case in which the moving wall is more especially on the inner side of the ring so that a shaft or the like inserted through the ring may be clamped.

It is also possible to have a helical form, see FIG. 9 with the clamping element 6*c*.

In the cases considered so far the clamping element has only had one moving wall. It is however perfectly possible to have more than one moving wall as longitudinal sides of the bar, this being illustrated in FIG. 10.

In the case of a further embodiment of the clamping bar of the invention the plastic molded structure including the moving wall is also supported by a support bar of rigid material, which surrounds the molded structure with the exception of the moving wall. This support bar is however formed by a running length of support moulding (i.e. an extruded or other structure with a constant cross section) cut off to the desired length.

As a further possibility the plastic molded structure may be in the form of a plastic tubular or hollow moulding cut off to the desired length, the pressure space being closed at the ends by separate caps or plugs with a compressed air inlet port if desired.

These two possible systems in accordance with the invention are embodied in the working example to be seen in FIGS. 11, 12 and 14. The moving wall used here has the same cross section as was the case with the earlier embodiments so that it is again referenced 10. However it will be clear that in every case it would be possible to use another form of cross section, as for instance that shown in FIGS. 15 and 16. The supporting moulding 32 is in the form of a channel as was the case with FIGS. 2 through 4, but it is however open at the ends so that it may be cut off to a desired size from a running length of such material. The same applies for the tubular plastic moulding 33 whose cross section only differs from the earlier-described plastic molded structure 12 inasfar as it is also closed at the side opposite to the moving wall 10 (and the ends are open as well). The interior of the hollow plastic moulding forms the pressure space 8*a*. There are separate terminating caps 34 and 35 fixed on the ends of this clamping bar 6*d*. The hollow plastic moulding 33 may be bonded in position in the support moulding 32. One of the end caps 34 is provided with a compressed air inlet port. The end caps may also be made like plugs able to be inserted into the hollow plastic moulding 33 so that in this case it is a question of terminating plugs.

In other aspects this embodiment of the invention described in connection with FIGS. 11 through 14 is similar to the initially described ones.

FIG. 11 has been additionally amplified by the use of broken lines to indicate features such as attachment pins 36 and 37 on the end caps 34 and 35 with whose aid the clamping bar may be attached to a table 1 for instance. This feature may also be employed with the arrangement of FIGS. 2 through 4.

FIG. 13 is an individual view of a running length of hollow plastic moulding 33*a*, i.e. extruded section or the like with a constant cross section, as employed for the production of the clamping bar 6*d*. It will be seen that the walls of the moulding other than the folds adjacent moving wall 10 are so thick that it is possible to dispense with a separate support bar. The necessary strength is provided in this case by making the moulding with the requisite thickness. The result is then a clamping bar that is very simple to construct because such a length of plastic mounding 33*a* only has to be shut off at its ends with caps or plugs.

In the case of a further possible form of the invention (not illustrated) for which plastic hollow moulding is cut off to the required length, the moving wall is made of soft plastic and the other walls are made of hard plastic, the two materials being integrally molded to produce a single structure. The cross section may be like that of FIG. 13, although the walls other than the moving wall may be thin, i.e. thinner that the moving wall. In this case as well it is possible to dispense with a support bar.

On the other hand if a plastic molded structure is used in a support bar it is expedient to make the molded structure of soft resin.

It may also be an advantage to fashion the clamping element so that it is able to be plastically bent, this being more especially possible if a support bar made of metal is used whose walls are suitably thin and which has acute-angled notches 38 as marked in FIG. 12 for example so that the clamping bar may be shaped permanently to comply with crooked or bent workpieces.

In accordance with a further feature of the invention the clamping element is made completely of heat resistant material so that it will not be damaged by hot metal chips or shavings on a machine tool.

We claim:

1. A short stroke clamping actuator for exerting a clamping force on a workpiece, comprising an elongated rigid housing having a rigid bottom wall, spaced apart rigid sidewalls connected to said bottom wall and spaced apart rigid endwalls connected to said bottom wall, said housing having an elongated open front opposite from said back wall, an insert structure received in said housing, said insert structure having a movable wall extending across and closing said open front of said housing to define a pressure chamber with said housing, said pressure chamber being pressurizable to move said movable wall outwardly to engage and clamp a workpiece, said insert structure being open along an elongated opening at said rear wall of said housing, said insert structure including a clamping flange around said elongated opening thereof and engaged against said bottom wall of said housing, a retaining plate engaged over said clamping flange and over said bottom wall in said housing, and clamping means connected between said housing and said retaining plate for urging said retaining plate toward said bottom wall and against said flange for sealing said flange against said bottom wall.

2. The clamping actuator as claimed in claim 1 wherein said clamping means comprises at least one screw connected between said backwall of said housing and said retaining plate.

3. The clamping actuator as claimed in claim 1 wherein said insert structure includes sidewalls connected between said moveable wall and said clamping flange and engaged against said sidewalls of said housing, and endwalls connected between said moveable wall and said clamping flange, said endwalls of said insert structure engaged against said endwalls of said housing.

4. The clamping actuator as claimed in claim 3 wherein said endwalls of said insert structure and said housing, and end portions of said open front of said housing are curved.

5. The clamping actuator as claimed in claim 3 wherein said endwalls of said insert structure and said housing, and the end portions of said open front of said housing are semi-circular.

6. The clamping actuator as claimed in claim 5 wherein said insert structure is made of a single piece of molded elastic resin.

7. The clamping actuator as claimed in claim 1 wherein said insert structure comprises a hollow plastic sectional piece including sidewalls engaged against said sidewalls of said housing and connected between said moveable wall and said clamping flange of said insert structure, said endwalls of said housing comprising removeable covers closing ends of said pressure chamber.

8. The clamping actuator as claimed in claim 1 including a compressed air connection connected into one of said sidewalls of said housing.

9. The clamping actuator as claimed in claim 1 wherein said insert structure is made of heat-resistant material.

10. The clamping actuator as claimed in claim 3 wherein said insert structure is made of a single piece of resin material, said housing being substantially in the form of a rectangular prism, said insert structure being in the form of a channel in said housing.

11. The clamping actuator as claimed in claim 1 wherein said movable wall is fashioned of elastic material.

12. The clamping actuator as claimed in claim 1 wherein said movable wall is corrugated with corrugations extending in parallelism to the longitudinal axis of the actuator.

13. The clamping actuator as claimed in claim 1 wherein said movable wall is joined with sides of said actuator by at least one fold as a joint.

14. The clamping actuator as claimed in claim 13 wherein said movable wall is essentially flat.

* * * * *